US005660540A

United States Patent [19]

Kang

[11] Patent Number: 5,660,540

[45] Date of Patent: Aug. 26, 1997

[54] VANE GUIDE APPARATUS OF A ROTARY COMPRESSOR

[75] Inventor: Heui Jong Kang, Suwon, Rep. of Korea

[73] Assignee: Samsung Electronics Co., Ltd., Suwon, Rep. of Korea

[21] Appl. No.: 680,849

[22] Filed: Jul. 16, 1996

[30] Foreign Application Priority Data

Sep. 26, 1995 [KR] Rep. of Korea ..... 1995-31952

[51] Int. Cl.[6] ..... F04C 18/356

[52] U.S. Cl. ..... 418/174; 418/256

[58] Field of Search ..... 418/174, 177, 418/256

[56] References Cited

U.S. PATENT DOCUMENTS 155,160 9/1874 Klein ..... 418/174

502,818 8/1893 Holland ..... 418/177

FOREIGN PATENT DOCUMENTS 531020 10/1921 France ..... 418/174

*Primary Examiner*—John J. Vrablik

*Attorney, Agent, or Firm*—Burns, Doane, Swecker & Mathis, L.L.P.

[57] ABSTRACT

A rotary compressor includes a stationary member composed of a plate member, and a downwardly projecting shaft defining a first axis. A roller is freely rotatably mounted on the shaft. A cylinder is rotatably mounted below the plate element with the roller disposed therein. The cylinder is rotatably driven about a second axis parallel to and spaced from the first axis. Vanes are mounted in radial slots formed in the cylinder for radial sliding movement relative to the cylinder to divide the cylinder into fluid-compressing and fluid-discharging chambers. The plate element includes an annular groove, and a ring is loosely mounted in the groove for rotation relative to the plate member about the first axis. A radially outer end of each vane includes a protuberance mounted in a respective slot formed in the ring. The ring thus functions as a guide for positioning radially inner ends of the vanes in close proximity to the outer periphery of the roller without being strongly biased thereagainst, thereby minimizing frictional wear of those inner ends. A film of oil is interposed between the roller and each vane.

11 Claims, 9 Drawing Sheets

VANE GUIDE APPARATUS OF A ROTARY COMPRESSOR

BACKGROUND OF THE INVENTION

The present invention relates to a rotary compressor having a stationary roller and a rotating cylinder.

In a conventional a rotary compressor, an eccentric roller provided in a cylinder rolls along an inner-wall of the cylinder. discharging the compressed gas in the cylinder. A plurality of slots are formed in the wall of the cylinder. In the slots are arranged respective vanes to separate an intake chamber from a discharge chamber.

FIGS. 11 and 12 show a typical rotary compressor. The rotary compressor comprises a motor 110, a cylinder 20 and stationary plate 10 housed in a housing 100. The motor 110 is a driving means for rotating the cylinder 20.

The stationary plate 10 comprises a plate member 18 having an inlet and an outlet (not shown) and an eccentric shaft 19 extended downward from the lower surface of the plate member 18. The stationary plate 10 sealingly covers the cylinder 20. Further, a stationary cylindrical bearing 120 is arranged at the periphery of the cylinder 20.

An inlet 130 and the outlet 140 penetrate the housing 100 and communicate with an inlet and an outlet (not shown) formed in the stationary plate 10. The latter inlet and the outlet are communicated with an intake chamber 40 and a discharge chamber 50 (FIG. 12) formed in the cylinder 20.

In the side wall of the cylinder 20 are provided two upwardly slots 41,43 in which two vanes 31,33 are slidingly provided. Near respective vanes 31,33 are provided grooves 35,37.

The center P of the shaft 19 of the stationary plate 10 is arranged eccentrically to the rotation center O of the cylinder 20 by a distance E.

The vanes 31,33 are facing each other. In order to always engage the front ends of vanes 31,33 with the periphery of the roller 27, at the rear end of vanes 31,33 there is installed an elastic means 32 of which both ends are fixed to the rear end of vanes 31,33. The elastic means 32 applies to the vanes 31,33 a force which biases both vanes toward the inside of the cylinder 20.

In the operation of the above rotary compressor, with the stationary plate 10 non-rotated, the cylinder 20 is rotated in the direction of the arrow as shown in FIG. 12 by the motor 110. Accordingly, vanes 31,33 are rotated while contacting the periphery of the roller 27 and gas is drawn into the intake chamber 40 of the cylinder 20 through the inlet of the stationary plate 10, and finally the compressed gas is discharged to the outside through the outlet of the stationary plate 10.

However, after a long duration of constant use of the conventional rotary compressor the front ends of vanes 31,33 are severely worn away since they are biased against the periphery of the roller 27 by the force of the elastic means 32. Also the elastic force of the elastic means decreases due to fatigue. Therefore, after the long use time the seal of the intake chamber 40 and the compression chamber 50 can no longer be assured, causing the efficiency of the intake and the discharge to decrease.

SUMMARY OF THE INVENTION

Accordingly, one object of the invention is to provide a rotary compressor, resolving this problem.

Another object of the invention is to provide a rotary compressor which eliminates the abrasion between the roller and the vane and increases compressor efficiency and the reliability.

According to the present invention, a rotary compressor comprises a cylinder rotated by a driving motor; a plurality of vanes mounted in a bi-directional slidable manner for rotating simultaneously with the rotation of the cylinder; a stationary plate placed on the upper opened cylinder and having a center shaft off-centered from a rotation shaft of the cylinder, a refrigerant inlet and a refrigerant outlet; a roller assembled with a circumference of the center shaft of the stationary plate and arranged in the cylinder; and a guiding means enabling said vane to be rotated with a gap against the circumference of the roller.

Further, the guiding means comprises a rotatable ring in the stationary plate for guiding the movement of the vane.

BRIEF DESCRIPTION OF THE DRAWINGS

The invention now will be described in detail with reference to the accompanying drawings, in which.

DETAILED DESCRIPTION OF THE PREFERRED EMBODIMENT

Figure 1:
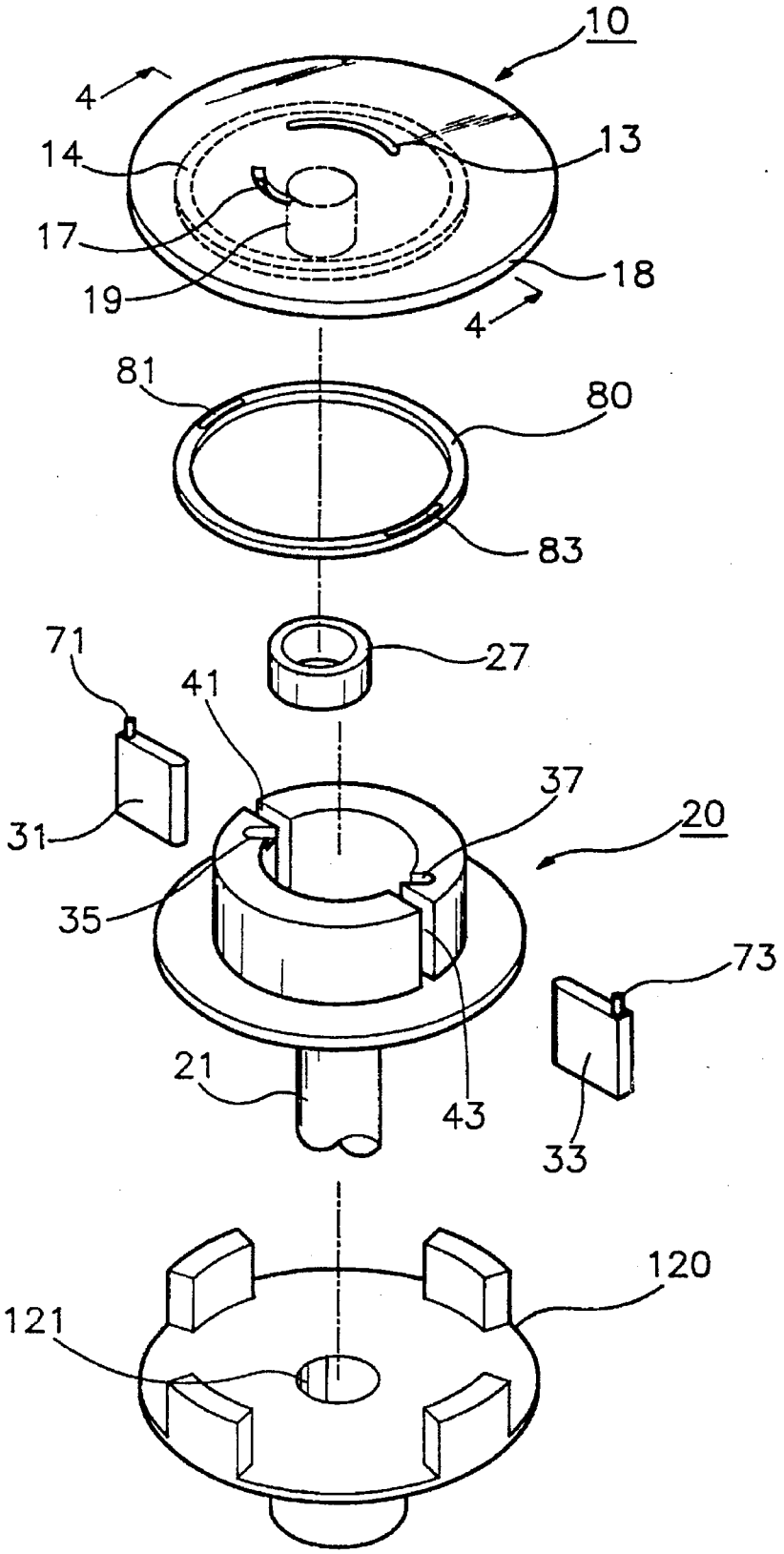
FIG. 1 is a fragmentary exploded perspective view of a rotary compressor according to the present invention.
Figure 11:
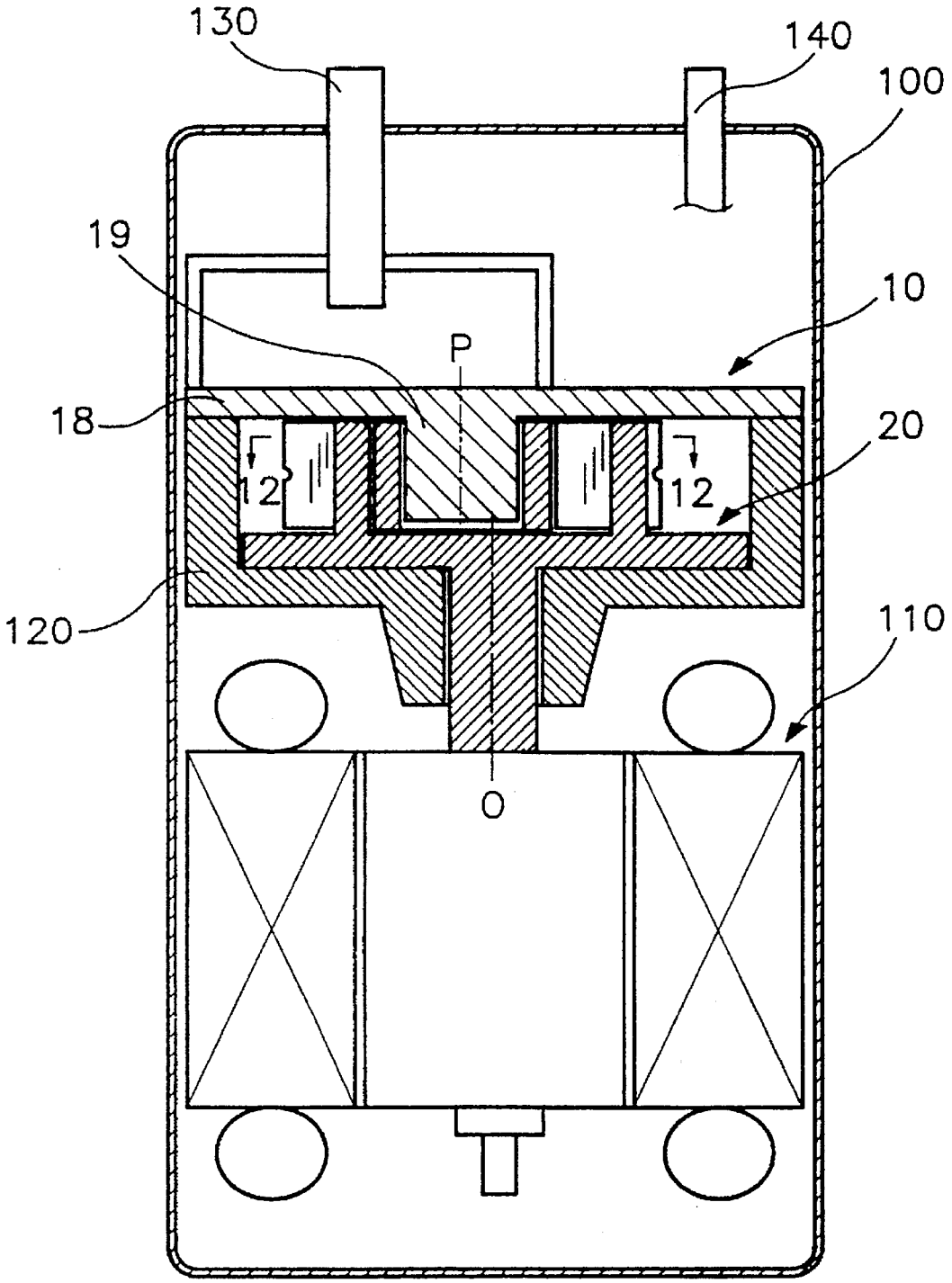
FIG. 11 (Prior Art)
FIG. 11 is a longitudinal sectional view of a rotary compressor according to the prior art.
Figure 12:
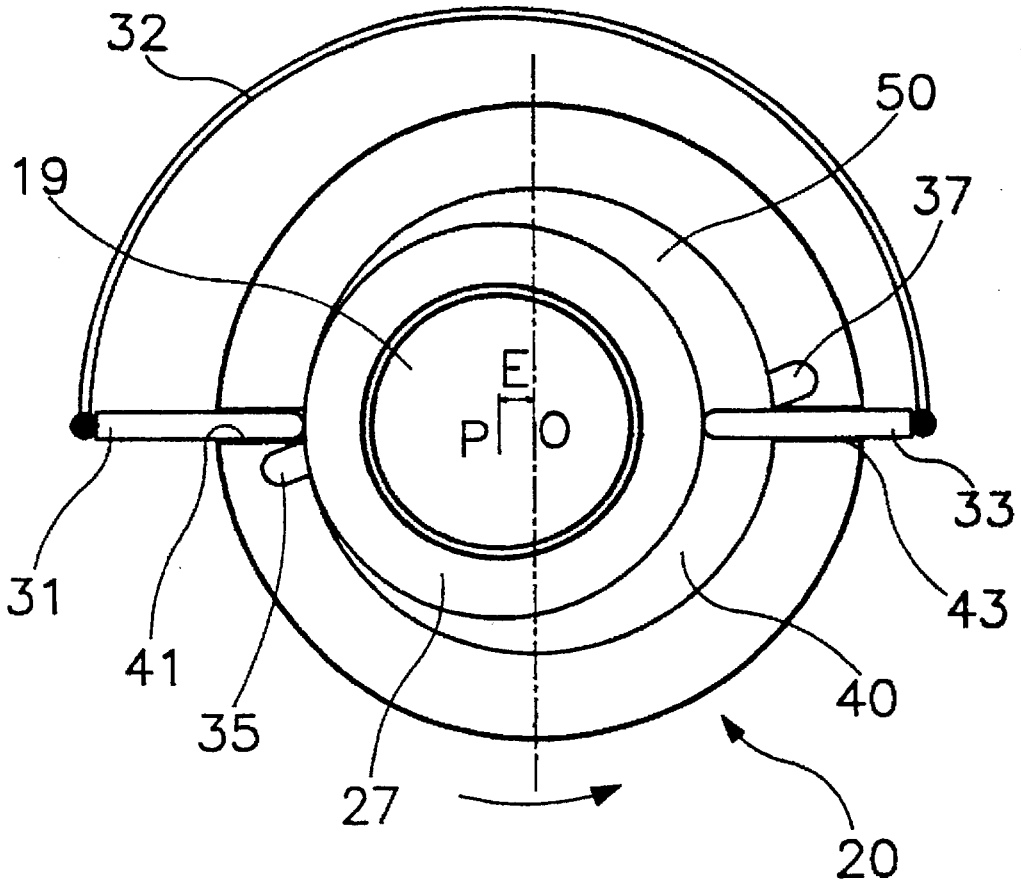
FIG. 12 (Prior Art)
FIG. 12 is a plan view taken along line 12—12 of FIG. 11.

FIG. 1 illustrates a rotary compressor according to the present invention. The same components as in the prior art shown in FIGS. 11 and 12 are designated by the same numerals. Thus, a detailed description of those parts will be omitted.

The upwardly opened cylinder 20 comprises a pair of slots 41,43 which face each other and a shaft 21 for rotating the cylinder 20. In the slots 41,43 are placed slidable vanes 31,33. The rotation shaft 21 is connected with a driving motor ( not shown ). At the rear portion of respective vanes 31,33 are provided protrusions 71,73 extended upward in a predetermined length. Adjacent to slots 41,43 are formed grooves 35,37 for discharging the compressed gas taken into the cylinder 20.

Above the cylinder 20 is provided a stationary plate 10 comprising a circular plate member 18 and an eccentric cylindrical shaft 19 extended from the lower surface of the plate member 18. On the eccentric shaft 19 is slidingly fitted an open ended roller 27. The roller 27 is arranged in the cylinder 20 so that a circumferential outer surface of the roller 27 contacts with an inner surface of cylinder 20 in line contact. The plate member 18 has an outlet 13 and an inlet 17 (FIG. 2A) of predetermined width and length for gas communication. The outlet 13 is an arch having a predetermined radius $R_O$ from a center O of the plate 18, whilst the inlet 17 is an arch having a predetermined radius $R_p$ from a center P of the eccentric shaft 19. Further, on the lower surface of the circular plate member 18 is provided a circular groove 14 for housing a vane guide ring 80 described later.

The radius of the groove 14 is larger than that of the outlet 13 and it extends from the center P of the eccentric shaft 19.

Figure 3:
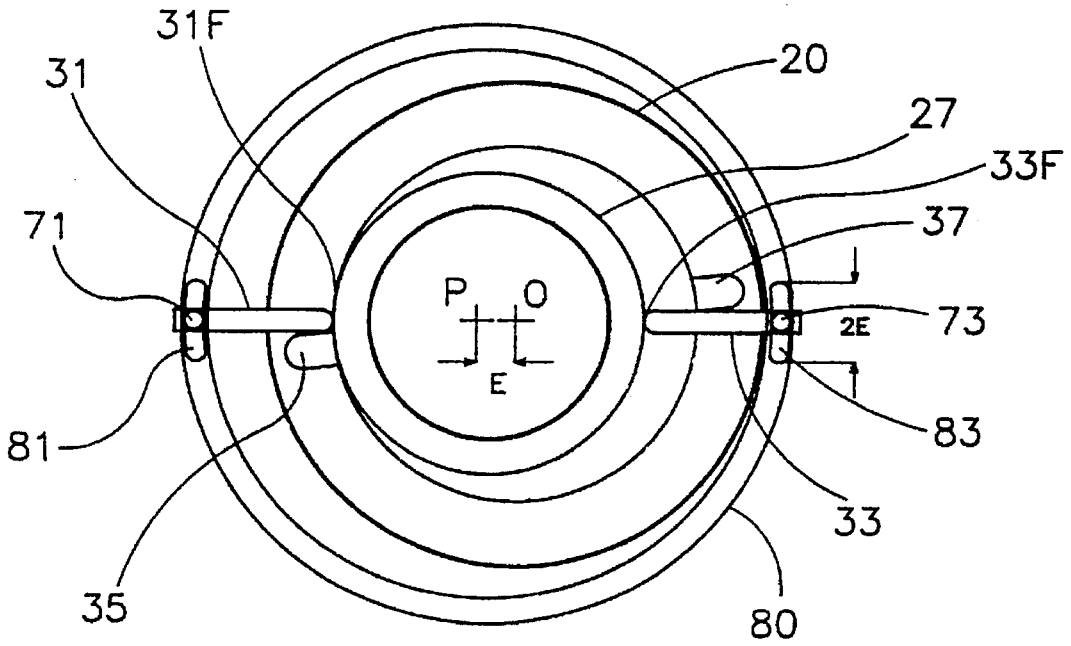
FIG. 3 is a plan view showing an arrangement of a roller and a vane bearing into a cylinder of the compressor of FIG. 1.

The vane guide ring 80 is slidingly fitted in the groove 14, enabling vanes 31,33 to rotate while radially inner ends thereof are situated closely proximate the outer periphery of the roller, with a film of oil interposed therebetween. Any spaces formed between the roller and the vanes are occupied by an oil film. As shown in FIG. 3, a pair of diametrically opposite guiding slots 81,83 are formed in the ring 80. Through the slots 81,83 are movably fitted respective protrusions 71,73 protruding from rear ends of respective ones of the vanes 31,33.

At the skirt of the cylinder 20 is provided a circular plate bearing 120 for rotatably supporting the cylinder 20. A hole 121 disposed at a center of the bearing 120 rotatingly receives the rotation shaft 21.

Figure 4:
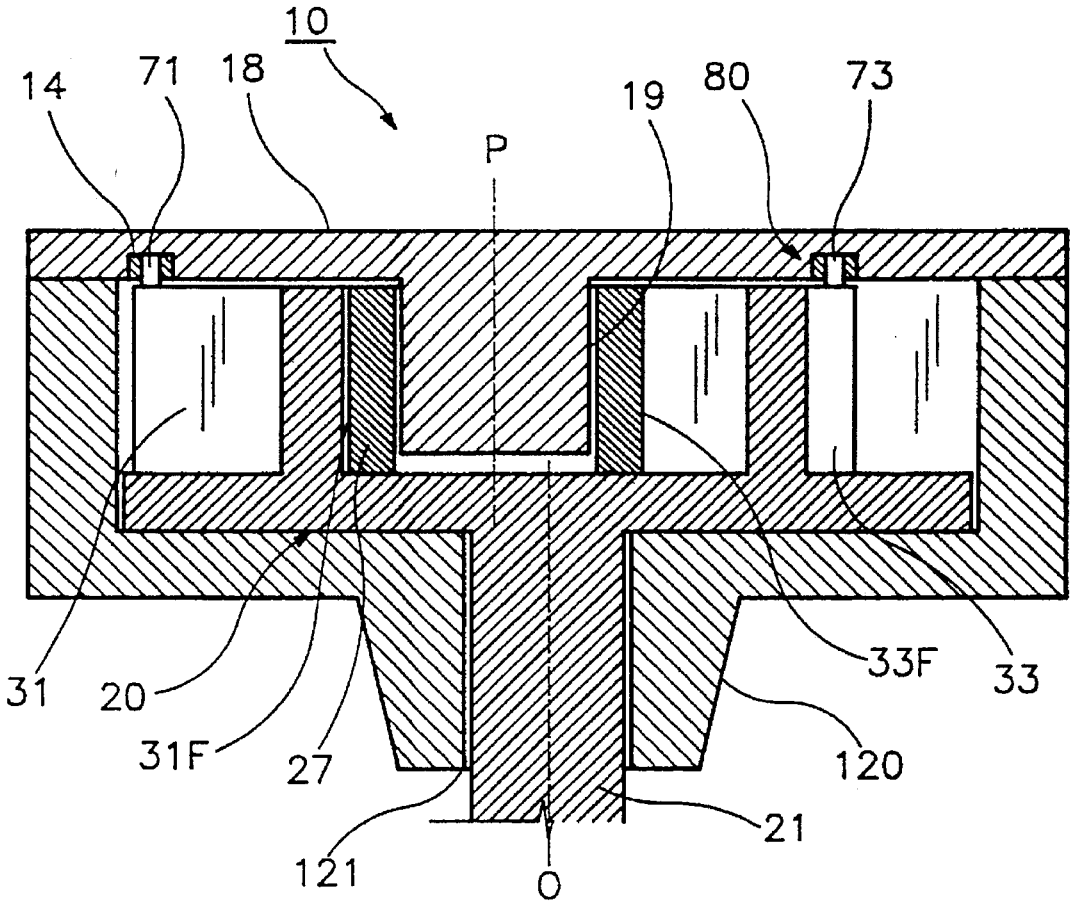
FIG. 4 is a longitudinal sectional view taken along line 4–4 of FIG. 1.

FIG. 4 is a longitudinal sectional view showing the arrangement of components illustrated above. The cylinder 20 is placed in the bearing 120. That is, the rotation shaft 21 extends downward to connect with a driving motor ( not shown ) through the hole 121 of the bearing ring 120. The roller 27 is located in the cylinder 20 in contact with the inner side wall of the cylinder 20. The stationary plate 10 is placed on the upper portion of the bearing 120, causing the inner space of the cylinder 20 to be sealed. The eccentric shaft 19 is disposed in the roller 27. Front ends 31F,33F of respective vanes 31,33 contact the periphery of the roller 27, with an oil film disposed between the vane and the roller. Respective protrusions 71,73 projected from each vane 31,33 are inserted into the guiding slots 81,83 of the ring 80. The center P of the eccentric shaft 19 or the roller 27 is spaced from the center O of the rotation shaft 21 by the distance E (FIG.3 ).

Figure 2A:
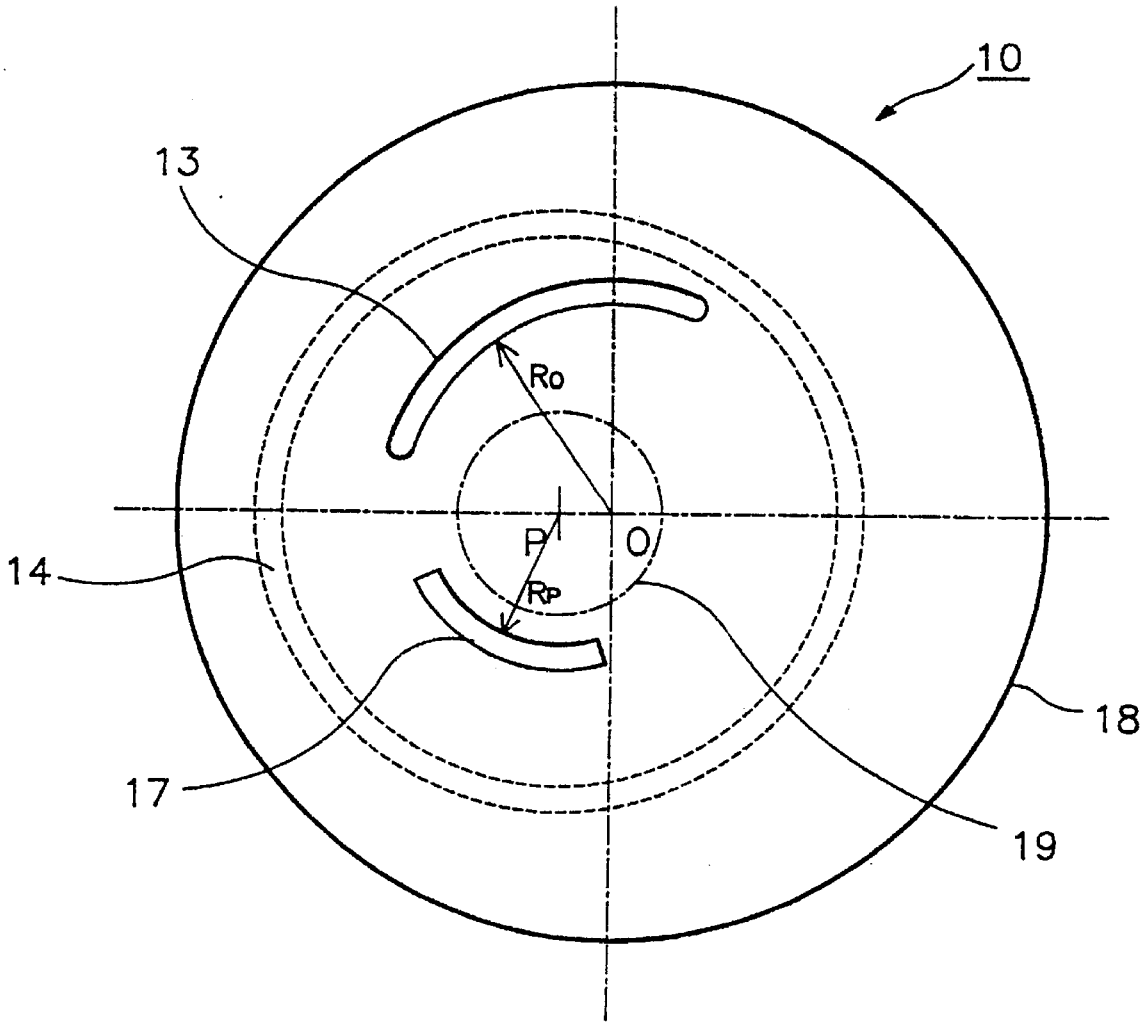
FIG. 2A is a top plan view of a stationary plate of the rotary compressor of FIGS. 1.
Figure 2B:
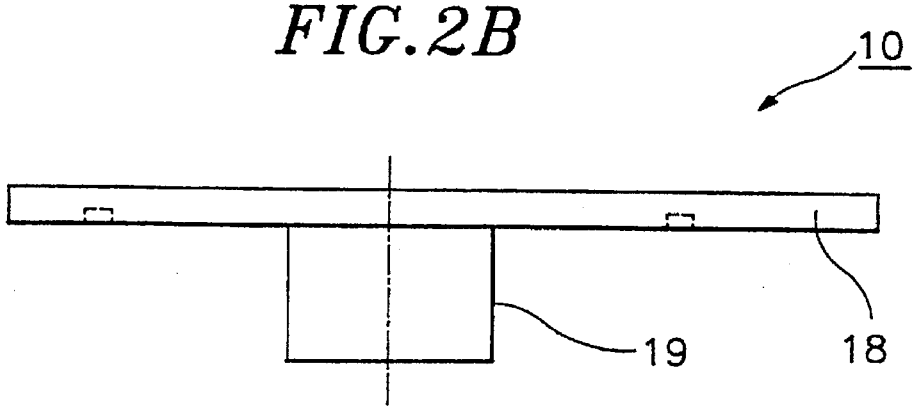
FIG. 2B is a side view of the stationary plate.

As shown in FIG. 2A, the circular groove 14 formed on the lower surface of the plate 18 is coaxial with the eccentric shaft 19. In the vane ring 80 housed in the groove 14, the circumferential length of the guiding slots 81,83 (FIG. 3) is more than twice the distance of the eccentricity E. Since vanes 1,33 rotating with the cylinder 20 are moved while in contact with the periphery of the roller 27 disposed eccentrically from the center O of the cylinder 20, when the cylinder 20 is rotated around the center O, each protrusion 71,73 of vanes 31,33 rotating around the center P is moved in the guiding slots 81,83 in the out-of-way manner. Therefore, as the vanes 31,33 are rotated along with the cylinder 20, the ring 80 is rotated in the groove 14 by the protrusions 71,73 of vanes 31,33. During the rotation of the ring 80, each front end 31F,33F of vanes 31,33 contacts on the periphery of the roller with an oil film interposed therebetween, and the vanes 31,33 are moved.

FIGS. 5 to 10 show the sequence operation of the rotary compressor. In these Figures, the view of the stationary plate 10 sealing the upper portion of the cylinder 10 is omitted. However, outlet 13 and inlet 17 formed on the plate 18 are illustrated by a broken line for a clearer understanding.

Figure 5:
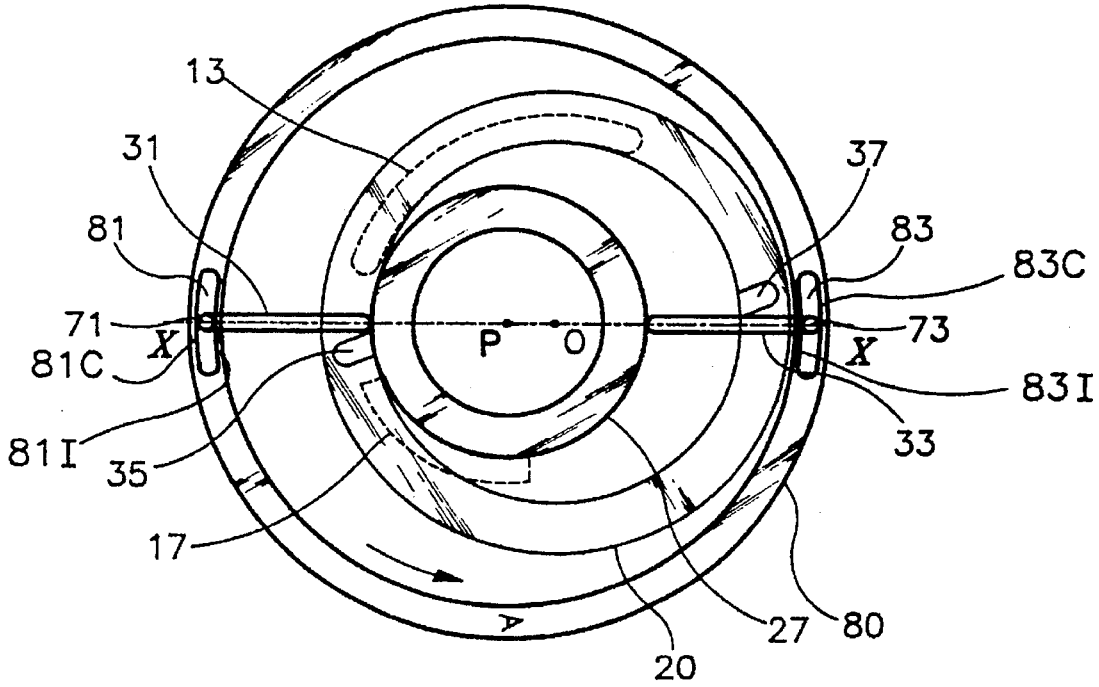
FIGS. 5 to 10 are plan views show the sequence of operation of the present invention.

FIG. 5 shows that vanes 31,33 are placed in 0° in respect to a transverse axis X—X passing the center O of the cylinder 20. The cylinder 20 is rotated in the direction of the solid line arrow by the rotation shaft 21 driven by the motor.

The inner space of the cylinder 20 is partitioned into two chambers by vanes 31,33 and roller 27. That is, assuming that the cylinder is rotated in the direction of the solid line arrow, the chamber disposed below the transverse or horizontal line X—X in FIG. 5 is named as the gas intake chamber 40, while the upper chamber is named as the compressed gas discharge chamber 50. During the rotation of the cylinder 20 in the solid arrow direction around the center O, vanes 31,33 slide in and out of the slots 41,43 and are rotated with the cylinder 20. The protrusion 73 of the vane 33 contacts on the inner wall 83I of the slot 83, while the protrusion 71 of the vane 31 contacts on the outer wall 81C of the slot 81. Therefore, the vane guiding ring 80 is turned around the center P along with the movement of vanes 31,33. During the movement of vanes 31,33, the chamber 40 is intercommunicated with the inlet 17 of the stationary plate 10 through the groove 35 formed on the upper portion of the cylinder 20, thus conducting the gas into the cylinder 20. On the other hand, since the chamber 50 is in the sealed condition, the already intaken gas in the cylinder is compressing. The compression mode continues until vanes 31,33 arrive at the 45° position with respect to the horizontal axis X—X as shown in FIG. 6.

Figure 6:
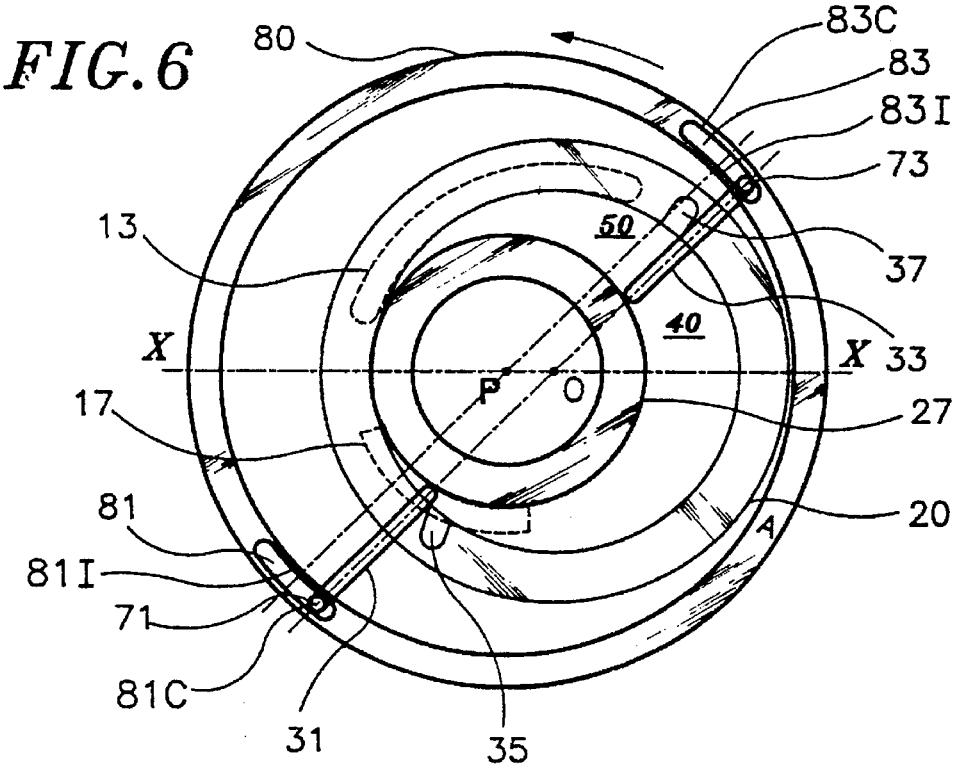

FIG. 6 illustrates a stage before the onset of the compressed gas discharge from the chamber 50. The new gas is conducted into the chamber 40 through the inlet 17, while the gas in the chamber 50 is gradually compressed.

During the rotation of the cylinder 20 around the center O, the protrusion 73 of the vane 33 contacts on the inner wall 83I of the guiding slot 83 and the protrusion 71 of the vane 31 contacts on the outer wall 81C of the guiding slot 81. The rotation force of the cylinder 20 is thus transferred to the vane guiding ring 80. Therefore, vanes 31,33 are rotated around the center O, while the ring 80 is rotated along with the cylinder 20 as the cylinder rotates around the center P. Consequently, the rotation of the vanes 31,33 continues and the vane position as shown in FIG. 6 is passing. The compressed gas in the chamber 50 is discharged through the outlet 13 via the groove 37.

Figure 7:
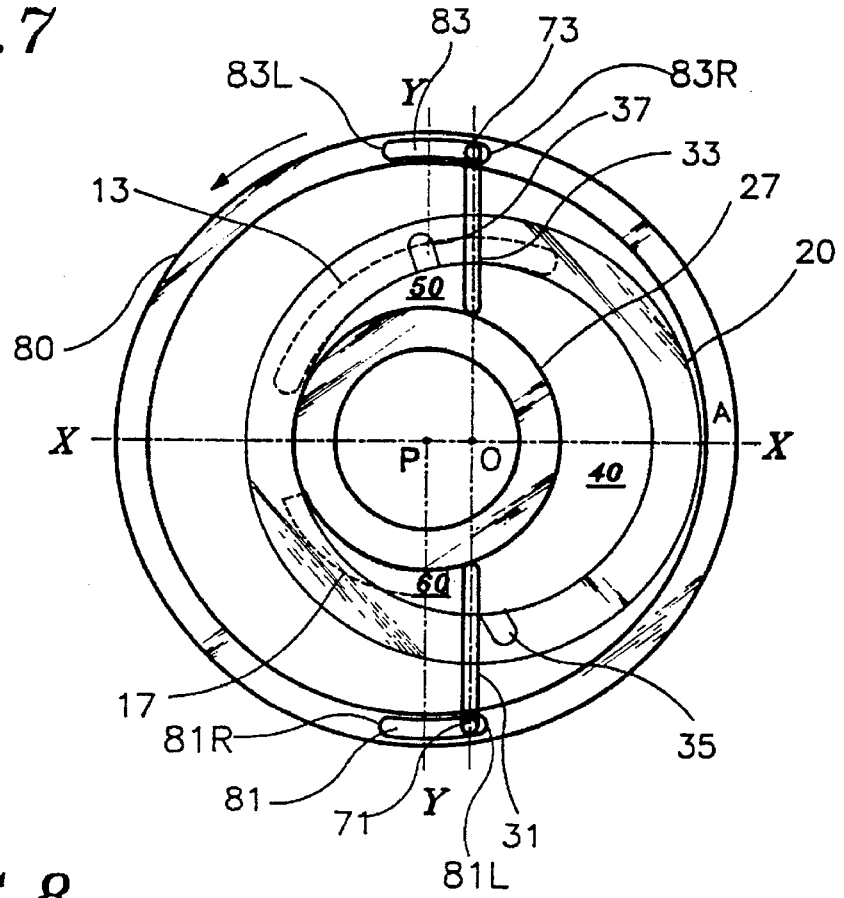

FIG. 7 shows the stage wherein vanes 31,33 are disposed to 90° with respect to the horizontal axis X—X. The gas is no longer drawn into the sealed chamber 40. A new chamber 60 is created at the place restricted by the lower area of the horizontal axis X—X and the left area of the vertical axis Y—Y. At that time, the gas is gradually compressed in the chamber 50 to be discharged. During this mode, each protrusion 71,73 contacts the slots 81,83 as illustrated above so that the rotation force of the cylinder 20 is transferred to the ring 80.

After following the stage of FIG. 7, the gas of the chamber 40 is compressed and the gas of the chamber 50 is continually compressed to be discharged and also the gas is conducted in the chamber 50 through the inlet 17.

Figure 8:
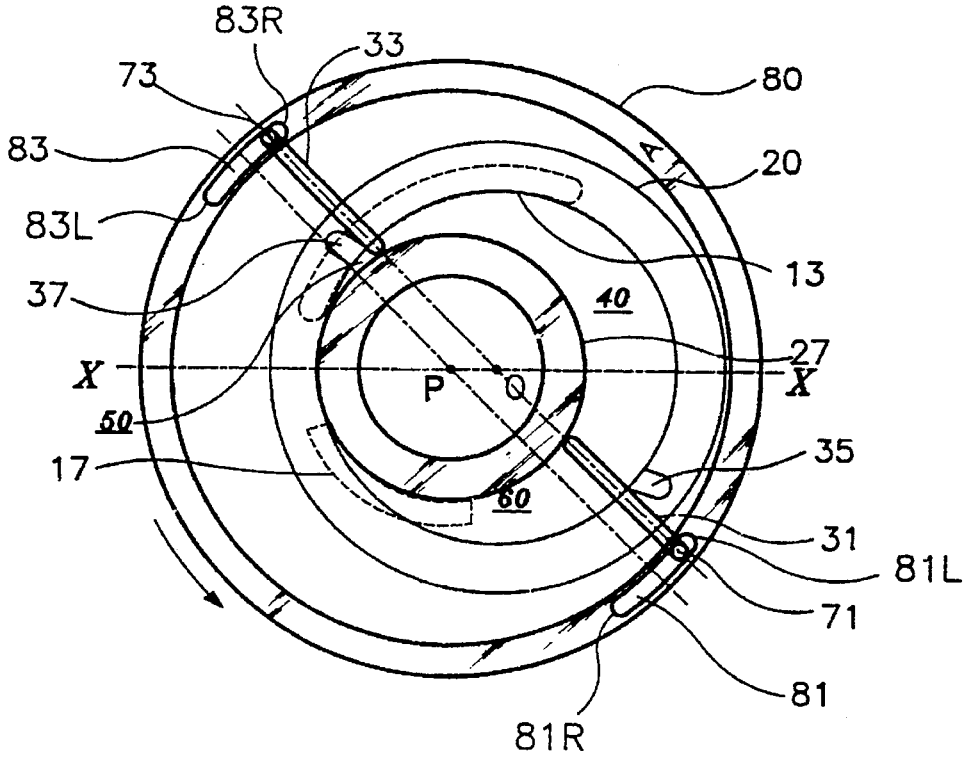

FIG. 8 shows that the simultaneous rotation of vanes 31,33 as well as ring 80 as illustrated above makes vanes 31,33 disposed at 135° with respect to the horizontal axis X—X. The gas of the sealed chamber 40 is gradually compressed. Further, the gas of the chamber 50 is continually discharged through the outlet 13, while the gas is continually drawn into the chamber 60 through the inlet 17.

Figure 9:
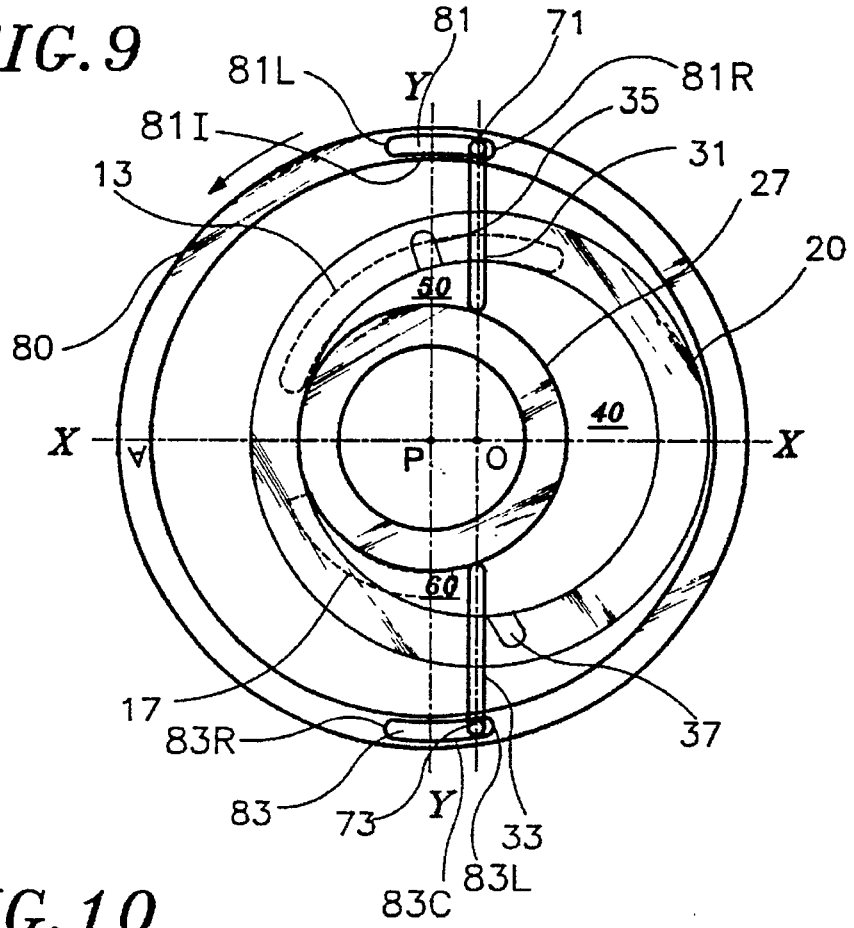

FIG. 9 illustrates the location of vanes 31,33 at 270° relative to the horizontal axis X—X. The protrusion 73 disposed at the upper area of the horizontal axis X—X as shown in FIG. 7 is located at the lower area of the horizontal axis X—X, while the protrusion 71 disposed at the lower area of the horizontal axis X—X as shown in FIG. 7 is located at the upper area of the horizontal axis X—X. As vanes 31,33 are passing the stage of 180° relative to the horizontal axis X—X, the protrusion 73 located adjacent to the right end 83R of the slot 83 is moved adjacent to the left end 83L of the slot 83, the protrusion 71 located adjacent to the left end 81L of the slot 81 is moved adjacent to the right end 81R of the slot 81.

At the same time, the protrusion 71 of the vane 31 contacts on the inner wall 81I of the slot 81 and the protrusion 73 of the vane 33 contacts on the outer wall 83C of the slot 83, enabling the rotation force of the cylinder 20 to be transferred to the ring 80. Then, vanes 31,33 continue to be rotated around the center O and the ring 80 continues to be rotated around the center P.

Into the chamber 60 the gas is drawn through the inlet 17, the gas of the sealed chamber 40 is compressed without the entry of more gas, and the gas of the chamber 50 is discharged to the outside through the outlet 13.

Figure 10:
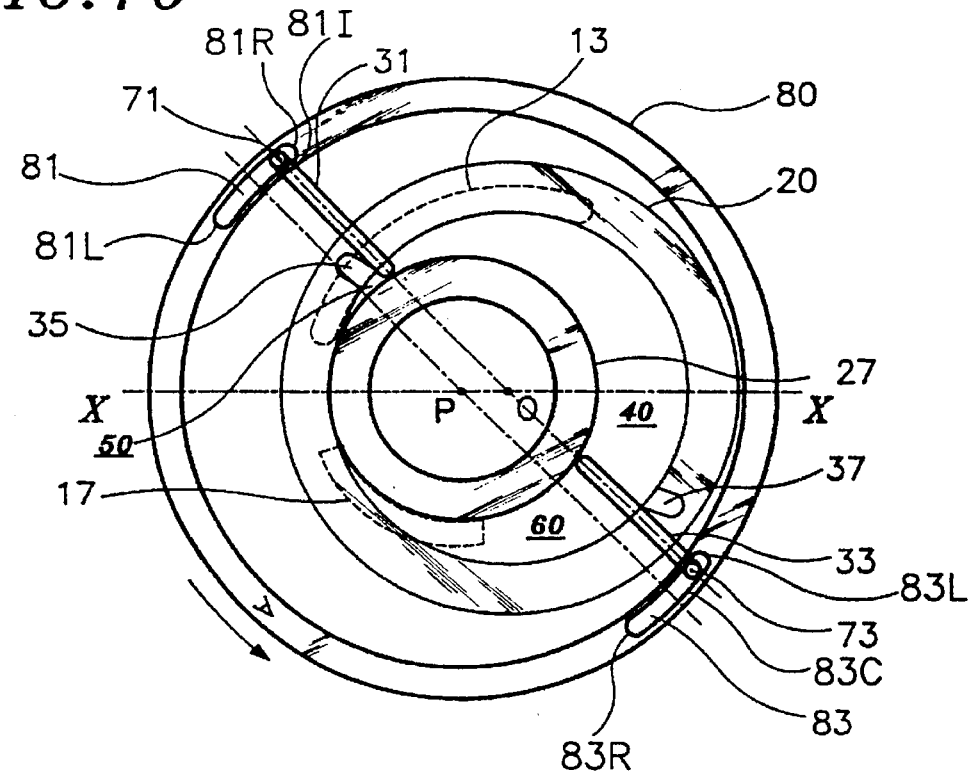

FIG. 10 shows the location of vanes 31,33 at 315° relative to the horizontal axis X—X. Each protrusion 71,73 contacts to the respective slot 81,83 as illustrated in FIG. 9, thus transferring the rotational force of the cylinder 20 to the ring 80.

After the continuous rotation of the cylinder 20 in the solid line arrow direction, vanes 31,33 are located the same as shown in FIG. 5. The rotary compressor of the present invention is operated by the above cycle, which is characterized by an intake mode, a compressed mode and a discharge mode.

As is apparent from the above explanation, since the vanes 31,33 are guided by the ring 80 during the rotation of the cylinder 20 and are moved across the peripheral of the roller 27 without being compressed thereagainst no abrasion can occur at the interface between the vanes 31,33 and the roller since a film of oil is interposed there between.

Therefore, a gap can not be created between the vanes 31,33 and the roller 27 even during a long period of use. This increases the compression efficiency and the discharge efficiency. The components of the rotary compressor can be used semipermanently, having an effect of increasing reliability.

Additionally, a modified embodiment can be exhibited within the scope of the invention. For instance, the embodiment employed only illustrate two vanes, however, changing the quantity of the vanes is possible. That is, the present invention is applicable to a rotary compressor having more than two vanes. The length of the inlet and the outlet would be modified according to the quantity of vanes.

What is claimed is:

1. A rotary compressor for compressing fluid, comprising:

a stationary body including a plate member and a shaft depending downwardly therefrom, the shaft defining a first axis, the plate member including a fluid inlet for uncompressed fluid and a fluid outlet for compressed fluid;

a roller freely rotatably mounted on the shaft;

a cylinder disposed below the plate member, with the roller disposed within the cylinder in contact with an inner wall thereof, the cylinder being rotatable about a second axis disposed eccentrically and parallel with respect to the first axis, the cylinder including a plurality of slots extending radially therethrough;

a plurality of vanes disposed for radial sliding movement in respective ones of the slots while being rotated with the cylinder; and a guiding structure for positioning the vanes such that the radially inner ends thereof are maintained closely proximate the outer periphery of the roller without being biased thereagainst.

2. The rotary compressor according to claim 1 wherein a film of oil is interposed between the roller and the radially inner end of each vane.

3. The rotary compressor according to claim 1 wherein the guiding structure comprises a ring mounted on the plate member for rotation relative thereto, the vanes being operably connected thereto to be constrained against radial movement relative thereto.

4. The rotary compressor according to claim 3 wherein the ring is rotatable relative to the plate member about the first axis.

5. The rotary compressor according to claim 3 wherein the plate member includes an annular groove, the ring mounted in the groove for sliding movement therein.

6. The rotary compressor according to claim 3 wherein the vanes include a diametrically opposed pair of vanes, a common plane of the pair of vanes lying in a common plane containing the second axis.

7. The rotary compressor according to claim 3 wherein each vane includes an upwardly extending protrusion movably disposed in a respective circumferentially extending slot formed in the ring.

8. The rotary compressor according to claim 7 wherein the protrusion is formed on a radially outer end of the vane.

9. The rotary compressor according to claim 7 wherein a length of each of the circumferentially extending slots in the circumferential direction is at least two times that of a distance between the first and second axes.

10. The rotary compressor according to claim 7 wherein the protrusion of each vane contacts a circumferentially extending wall of a respective circumferentially extending slot for imparting rotation to the ring when the cylinder is rotated.

11. The rotary compressor according to claim 10 wherein the protrusion of one vane contacts a radially inner one of the walls of its respective circumferentially extending slot, while the protrusion of a diametrically opposite vane contacts a radially outer one of the walls of its respective circumferentially extending slot.

* * * * *